US009282805B2

(12) United States Patent
Stredak et al.

(10) Patent No.: US 9,282,805 B2
(45) Date of Patent: Mar. 15, 2016

(54) COSMETIC UNIT WITH SQUEEZABLE CONTAINER

(75) Inventors: Helmut Stredak, Aurach (DE); Manuela Geuther, Ansbach (DE)

(73) Assignee: GEKA GmbH, Bechhofen (DE)

( * ) Notice: Subject to any disclaimer, the term of this patent is extended or adjusted under 35 U.S.C. 154(b) by 289 days.

(21) Appl. No.: 13/885,963

(22) PCT Filed: Nov. 17, 2011

(86) PCT No.: PCT/EP2011/070401

§ 371 (c)(1),
(2), (4) Date: Jul. 31, 2013

(87) PCT Pub. No.: WO2012/066102

PCT Pub. Date: May 24, 2012

(65) Prior Publication Data

US 2013/0315646 A1 Nov. 28, 2013

(30) Foreign Application Priority Data

Nov. 17, 2010 (DE) ..... 20 2010 012 918 U

(51) Int. Cl.
*A46B 11/00* (2006.01)
*A45D 40/26* (2006.01)

(52) U.S. Cl.
CPC ..... *A45D 40/262* (2013.01); *A45D 40/267* (2013.01)

(58) Field of Classification Search
CPC ..... A45D 40/262; A45D 40/267
USPC ..... 401/126, 183, 184
See application file for complete search history.

(56) References Cited

U.S. PATENT DOCUMENTS

| | | | | |
|---|---|---|---|---|
| 3,951,157 | A * | 4/1976 | Idec | 401/122 |
| 5,492,426 | A | 2/1996 | Gueret | |
| 5,573,340 | A * | 11/1996 | Gueret | 401/126 |
| 6,447,191 | B1 * | 9/2002 | Vasas | 401/7 |
| 6,715,951 | B2 * | 4/2004 | Gueret | 401/130 |
| 6,773,187 | B2 * | 8/2004 | Gueret | 401/130 |
| 6,866,437 | B2 * | 3/2005 | Gueret | 401/130 |
| 7,040,827 | B2 * | 5/2006 | Gueret | 401/130 |
| 7,381,003 | B1 * | 6/2008 | Chang | 401/130 |
| 2002/0048481 | A1 | 4/2002 | Gueret | |
| 2004/0131414 | A1 | 7/2004 | Delage | |
| 2006/0093425 | A1 * | 5/2006 | Gueret | 401/129 |
| 2007/0000566 | A1 | 1/2007 | Gueret | |
| 2007/0134051 | A1 * | 6/2007 | Todd | 401/205 |
| 2009/0020551 | A1 | 1/2009 | Malvar et al. | |

FOREIGN PATENT DOCUMENTS

| | | |
|---|---|---|
| CN | 1176211 A | 3/1998 |
| CN | 1290641 A | 4/2001 |

(Continued)

*Primary Examiner* — Jennifer C Chiang

(57) ABSTRACT

A cosmetic unit, in particular a mascara unit, having a reservoir for containing a cosmetic and having a cosmetic applicator for applying the cosmetic, in which the cosmetic applicator can be inserted into the reservoir so that it is loaded with the cosmetic contained in the reservoir, wherein at least one wall section of the reservoir is elastically embodied so that by exerting pressure on the above-mentioned region, a significant portion of the stored cosmetic can be pushed out of a reservoir region that is farther from the applicator into a reservoir region that is closer to the applicator; the region closer to the applicator is separated from the region farther from the applicator by means of a partition wall that has a plurality of through openings spaced apart from one another through which the cosmetic can be pushed into the region closer to the applicator.

18 Claims, 3 Drawing Sheets

(56) References Cited

FOREIGN PATENT DOCUMENTS

| | | | |
|---|---|---|---|
| DE | 60015889 | T2 | 11/2005 |
| EP | 1086904 | A1 | 3/2001 |
| EP | 1726233 | A2 | 11/2006 |
| FR | 2908019 | A1 | 5/2008 |
| JP | H06296520 | A | 10/1994 |
| JP | 2006305190 | A | 11/2006 |
| JP | 2007007392 | A | 1/2007 |

* cited by examiner

COSMETIC UNIT WITH SQUEEZABLE CONTAINER

FIELD OF THE INVENTION

The invention relates to a cosmetic unit.

BACKGROUND OF THE INVENTION

Cosmetic units that have a reservoir for containing the cosmetic to be applied and a cosmetic applicator for applying the cosmetic have been known in a wide variety of forms for a long time.

Typically, the cosmetic applicator can be inserted into the reservoir so that it is dipped into the cosmetic stored therein and thus loaded with the necessary quantity of cosmetic.

The problem frequently arises that it is not easy to use up all of the cosmetic contained in the reservoir because as the level of cosmetic in the reservoir decreases, it becomes more and more difficult to insert the cosmetic applicator into the reservoir so that it dips into the remaining cosmetic stored therein. This is because the usual cosmetics are not, for example, highly fluid requiring only a slight shaking of the reservoir in order to wet the cosmetic applicator contained in it. Instead, the usual cosmetics are mostly of a highly viscous or even paste-like consistency. In other words, they have a tendency to creep and thus to settle in the bottom region of the reservoir under the influence of gravity. In this situation, it is inconvenient that the usual cosmetics, as a rule, cannot be easily made to spread uniformly onto the cosmetic applicator, not even by shaking.

In order to be able by and large to completely use up the cosmetic despite this, it is generally necessary to largely adapt the interior cross-section of the reservoir to the contour of the cosmetic applicator. It is useful, for example, to connect a cosmetic applicator in the form of a cylindrical brush to a likewise cylindrical reservoir whose inner diameter is of a size commensurate with the outer diameter of the brush. In this way, it is possible to ensure that largely until the end, the cosmetic applicator is always able to dip into the cosmetic compound and thus also still be satisfactorily wetted when the cosmetic compound is running low.

A reservoir that closely encompasses the cosmetic applicator, however, has only a limited storage capacity since in many cases, it does not make sense to dip the cosmetic applicator deeper than necessary in the still completely full reservoir.

By contrast, cosmetic reservoirs that have an inner cross-section that is significantly larger than the outer diameter of the cosmetic applicator are unsatisfactory from the standpoint of being able to use up the cosmetic compound. In a reservoir embodied in this way, the tendency of the cosmetic compound to settle at the bottom of the reservoir results in the fact that early on, it is no longer possible to dip the applicator all the way into the cosmetic compound even though a considerable quantity of cosmetic compound is actually still contained in the reservoir.

In light of this situation, the object of the invention is to create a cosmetic unit that has a reservoir whose contents can be better or more easily used up than with known reservoirs of a comparable size.

SUMMARY OF THE INVENTION

According to the invention, a cosmetic unit is provided (particularly in the form of a mascara unit or a lip gloss or eyeshadow unit), which has a reservoir for containing the cosmetic and a cosmetic applicator for applying the cosmetic. The cosmetic applicator can be inserted into the reservoir so that it is loaded with the cosmetic contained in the reservoir. According to the invention, at least one wall section of the reservoir is elastically embodied so that exerting pressure on this wall section can push a significant portion of the stored cosmetic out of a reservoir region that is farther from the applicator into a reservoir region that is closer to the applicator. The region closer to the applicator is separated from the region farther from the applicator by means of a partition wall that has a plurality of through openings spaced apart from one another through which the cosmetic can be pushed into the region closer to the applicator.

In this way, it is possible for cosmetic compound, which has collected in a region of the reservoir that can no longer be reached by the cosmetic applicator, to be transported into the region of the cosmetic applicator by exerting pressure on the reservoir so that the cosmetic applicator is more easily wetted by the cosmetic compound that is now kept in its vicinity for a while, although it may still be necessary to deliberately move the cosmetic applicator back and forth somewhat in the region associated with it.

The presence of the partition wall results in the fact that pressing on the reservoir successfully brings the required quantity into the vicinity of the cosmetic applicator for a period of time. The need to exert pressure on the reservoir in order to effectively bring the cosmetic applicator into contact with the cosmetic can therefore be eliminated for the whole time of the application, which is often composed of repeated insertions of the cosmetic applicator into the reservoir and repeated withdrawals of the cosmetic applicator from the reservoir. Instead, it is preferably sufficient to exert pressure on the reservoir just once in connection with a particular application and thus to cause the cosmetic to travel through the partition wall into the vicinity of the cosmetic applicator where the cosmetic is then held for a time by the partition wall.

Preferably, the partition wall is embodied so that it has a design similar to a basket. Ideally, it is a basket. In this variant, therefore, the partition wall does not merely have an exclusively planar span, but instead has a three-dimensional shape. This three-dimensional shape of the partition wall results in the fact that the partition wall, on its side oriented toward the region that is farther from the applicator, has a larger surface area than a partition wall that is only planar. This yields a larger total cross-section of the openings via which the cosmetic compound can be pressed out of the region farther from the applicator into the region closer to the applicator, without having to make the cross-section of each individual opening too large.

Preferably, the cosmetic unit is the partition wall is designed, situated, and matched to the specific applicator so that when the applicator is inserted all the way into the reservoir, the partition wall provides an enclosure on five sides for at least a part of the section of the applicator directly used for the application. This ensures that the cosmetic applicator can be very effectively wetted as soon as a certain quantity of cosmetic has traveled out of the region farther from the applicator into the region closer to the applicator.

In another modification of the invention, essentially only the bottom surface and the two large side surfaces of the basket-like partition wall are provided with through openings. Such an embodiment represents a very good compromise. On the one hand, this compromise ensures that the partition wall has a high dimensional stability and is therefore not too powerfully deformed by the internal pressure produced when the reservoir is squeezed. On the other hand, this compromise ensures that after the pressure has been exerted on the reservoir, enough cosmetic still remains available in the region close to the applicator in order to nevertheless be able to wet the cosmetic applicator quite effectively.

The partition wall has preferably more than 4 and ideally even more than 10 or even more than 15 through openings.

Preferably, at least in some regions (preferably more than 25% of the free partition wall area), the cumulative area of the bridge pieces between the through openings is smaller than the area occupied by the sum of the through openings. Roughly speaking, the partition wall is thus largely composed of holes through which the cosmetic can be pushed. Between these holes, there are narrow bridge pieces, which are just wide enough that on the one hand, they do not unnecessarily hinder the passage of cosmetic from the region farther from the applicator into the region closer to the applicator, but on the other hand, they ensure that the cosmetic does not prematurely drip or creep out of the region closer to the applicator back into the region farther from the applicator. Ideally, the holes can be dimensioned to be small enough that once the cosmetic compound has been pushed out of the region farther from the applicator into the region closer to the applicator, the compound or most of it remains permanently in the region closer to the applicator.

The term "permanently" should preferably be understood to mean "forever," but for most practical applications, it is also sufficient if the term "permanently" is understood to mean "for at least one week" or "for at least 24 hours."

The reasoning behind this is as follows:

The set of bristles of the applicator or the actual applicator section must not be allowed to dry out, otherwise it tends to become encrusted over time and thus to become unusable. Such a drying out can be prevented by making sure that at least in most cases, for the interval of time between two uses, the set of bristles etc. is encompassed by cosmetic compound contained in the region closer to the applicator.

In a particularly preferred embodiment, the reservoir has a first part that is made of an essentially rigid material, preferably a hard elastic plastic, and has a second part that is made of a material that is significantly more flexible than the first part and the second part is directly connected to the first part.

In this case, the second part is at least flexible enough that in a new cosmetic unit (i.e. a cosmetic unit in the as-delivered state), at least 20% or better still 30% of the cosmetic compound contained in the reservoir can be pressed out of the region farther from the applicator into the region closer to the applicator by squeezing the second part composed of the flexible material with the fingers.

Naturally, the wall thickness of the second part and the material used for it can be routinely matched to each other so that the above-mentioned squeezing can occur without exertion of too much force or at least without the use of violent force. In order to be able to produce a cosmetic unit that truly can be almost completely emptied, in some cases, it can be advisable to embody the second part of the reservoir so that the region of the reservoir farther from the applicator can be decreased in size by more than 50%, preferably by more than 75%, or optimally, can be completely eliminated, when the second part of the reservoir is squeezed. In order to achieve this, it can be advisable to manufacture the second part out of a rubber-like compressible material and/or to embody it with very thin walls and/or to provide it with weakened areas that permit the second part to collapse when force is exerted on it so that the volume enclosed by it is sharply reduced.

In this connection, it can be useful to reinforce other wall regions of the second part and/or to embody them in the form of a spring element so that after the second part has been squeezed, these wall regions tend to (or essentially do in fact) force the second part back into its original shape as soon as the finger pressure on it is released. Alternatively, it would also be conceivable, for example, to insert a spiral spring for this purpose into the interior of this second part, which pushes the walls of the second part away from each other.

The advantage of such an at least two-part embodiment of the reservoir is that each of the two parts of the reservoir can be adapted to the tasks that it must perform through an appropriate selection of material. It is thus very simple to ensure that the first part of the reservoir, which serves as a mounting base for various components such as the partition wall and the stripper, can be embodied in a very precise, dimensionally stable way while the second can at the same time be embodied as easily deformable without high cost and without having to accept compromises with regard to the first part.

Preferably, the above-mentioned first and second parts of the reservoir are connected to each other by means of a sealed detent connection. In the context of series production, such a detent connection can be produced without excessive cost and at the same time, produces a sealed connection in a very reliable way.

Preferably, the cosmetic unit is designed so that the above-mentioned first or second part of the reservoir has at least one full-perimeter sealing strip extending in the circumference direction, which is embraced by a likewise full-perimeter sealing groove of the above-mentioned second or first part. In the optimal case, a means is simultaneously provided, which ensures a rotationally fixed attachment of the first part of the reservoir to the second part of the reservoir.

As a rule (apart from some exceptions), the first part of the reservoir has an insertion opening through which the cosmetic applicator can be slid into the reservoir from the outside. The first part of the reservoir—which is made of a material that is hard in comparison to that of the second part and ideally, is essentially dimensionally stable—can then simultaneously be used to provide a detent element that holds the cosmetic applicator so that it is immobilized relative to the first part of the reservoir in its home position, in fact so that the cosmetic applicator seals the insertion opening in the first part of the reservoir to prevent an undesired escape of the cosmetic.

Preferably, the component comprising the partition wall represents another component that is separate from the reservoir, i.e. from the first and second part of the reservoir, and constitutes a third part of the reservoir. This makes it easier to manufacture the partition wall in a three-dimensional design that does not require any compromises, but is instead almost exclusively oriented toward optimally achieving the function according to the invention.

In a modification of the invention, the above-mentioned first part has a receptacle into which the preferably basket-like partition wall can be slid and fixed in position, preferably through detent engagement with the above-mentioned first part. The partition wall is therefore fastened to the first part, which is particularly dimensionally stable.

The receptacle of the above-mentioned first part is preferably embodied so that the basket-like partition wall can be slid into the receptacle of the above-mentioned first part only from the side of the future reservoir. In this case, the receptacle preferably has at least one projection or circumferential collar that makes it impossible for the basket-like partition wall of the completely assembled cosmetic unit to be pulled out. In this way, the basket-like partition wall can be easily attached to the first part so that there is no danger of it being pulled out of the first part as the cosmetic applicator is being withdrawn.

In a particularly preferred embodiment, the cosmetic unit includes a stripper that is slid into the basket-like partition wall so that the partition wall encompasses it in a form-locked fashion along its circumference.

The receptacle of the above-mentioned first part is preferably embodied so that the basket-like partition wall, together with the stripper that it encompasses in a form-locked fashion, can be slid into the receptacle of the above-mentioned first part from the side of the future reservoir; preferably, only the basket-like partition wall is detent-connected to the above-mentioned first part, while the stripper has a collar that is secured in form-locked fashion between at least one projection or collar of the above-mentioned first part and the basket-like partition wall. This significantly simplifies assembly because together with the fastening of the basket-like partition wall, an attachment of the stripper is simultaneously also produced. As a result, the fastening of the basket-like partition wall does not result in any perceptible increase in assembly cost because the stripper is typically a component that must be separately installed anyway. This is because only in extremely few cases is the stripper composed of the same material as the reservoir and therefore meant to be injection molded of one piece with it.

Preferably, the basket-like partition wall has an intrinsically closed circumference region, i.e. a circumference region that is free of through openings. This circumference region constitutes a functional region with increased stability that can assist the basket-like partition wall in performing other functions.

This is because in a preferred embodiment, the second part of the reservoir rests against the basket-like partition wall in some regions in such a way that it supports the latter, preferably in the above-mentioned intrinsically closed circumference region of the basket-like partition wall.

In another preferred embodiment, the second part of the reservoir rests against some regions of the basket-like partition wall so that it is sealed relative to the basket-like partition wall and therefore delimits the space of the reservoir that is available for storing the cosmetic compound.

A cosmetic compound is preferably understood to mean a liquid, paste-like, or gel-like compound, i.e. not a powder and also not a powder composed of pellets or the like that are filled with liquid on the inside.

In some embodiments of the invention, the cosmetic compound can have flow properties or creeping properties so that—after it has been pressed from the region that is farther from the applicator through the partition wall to the region that is closer to the applicator—with a correctly stored cosmetic unit (bottom down), most of the cosmetic compound does not remain permanently in the region closer to the applicator, but under the influence of gravity, at least mostly travels back into the region farther from the applicator, preferably within the interval of one hour, or better still, within a period of 24 hours. Generally, the cosmetic compound at 20° C. has a viscosity of between 1.5 mPa·s and 500,000 mPa·s, or better still between 5 mPa·s and 10,000 mPa·s, and in the best case, between 50 mPa·s and 1,500 mPa·s, including the respective limits and preferably measured with a rotation viscometer (plate/plate).

Other advantages, possible embodiments, and functions of the invention ensue from the following exemplary embodiment described in conjunction with the drawings.

DETAILED DESCRIPTION OF THE PREFERRED EMBODIMENTS

Figure 1:
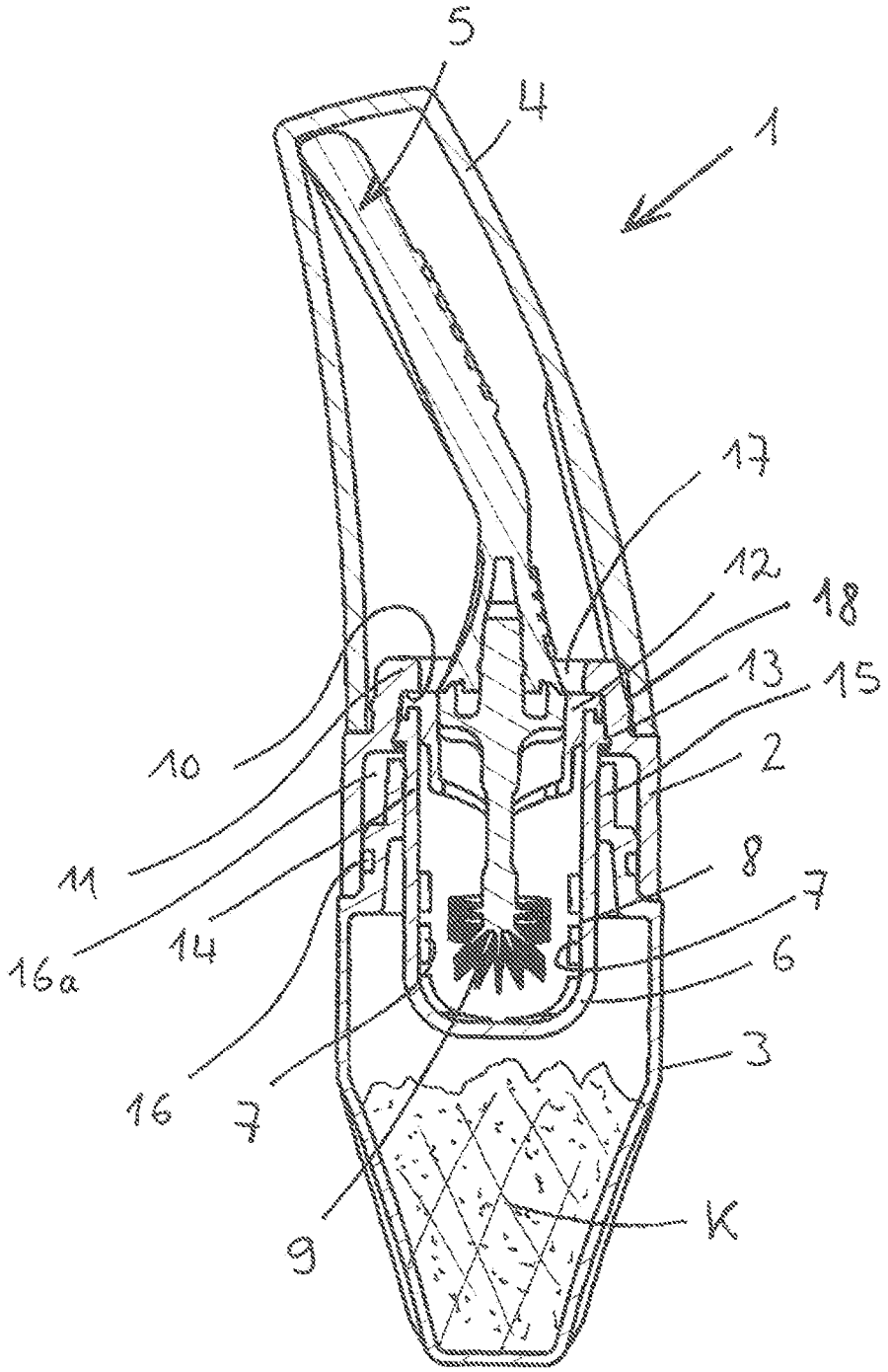
FIG. 1 shows a section through the applicator along a first cutting line.
Figure 2:
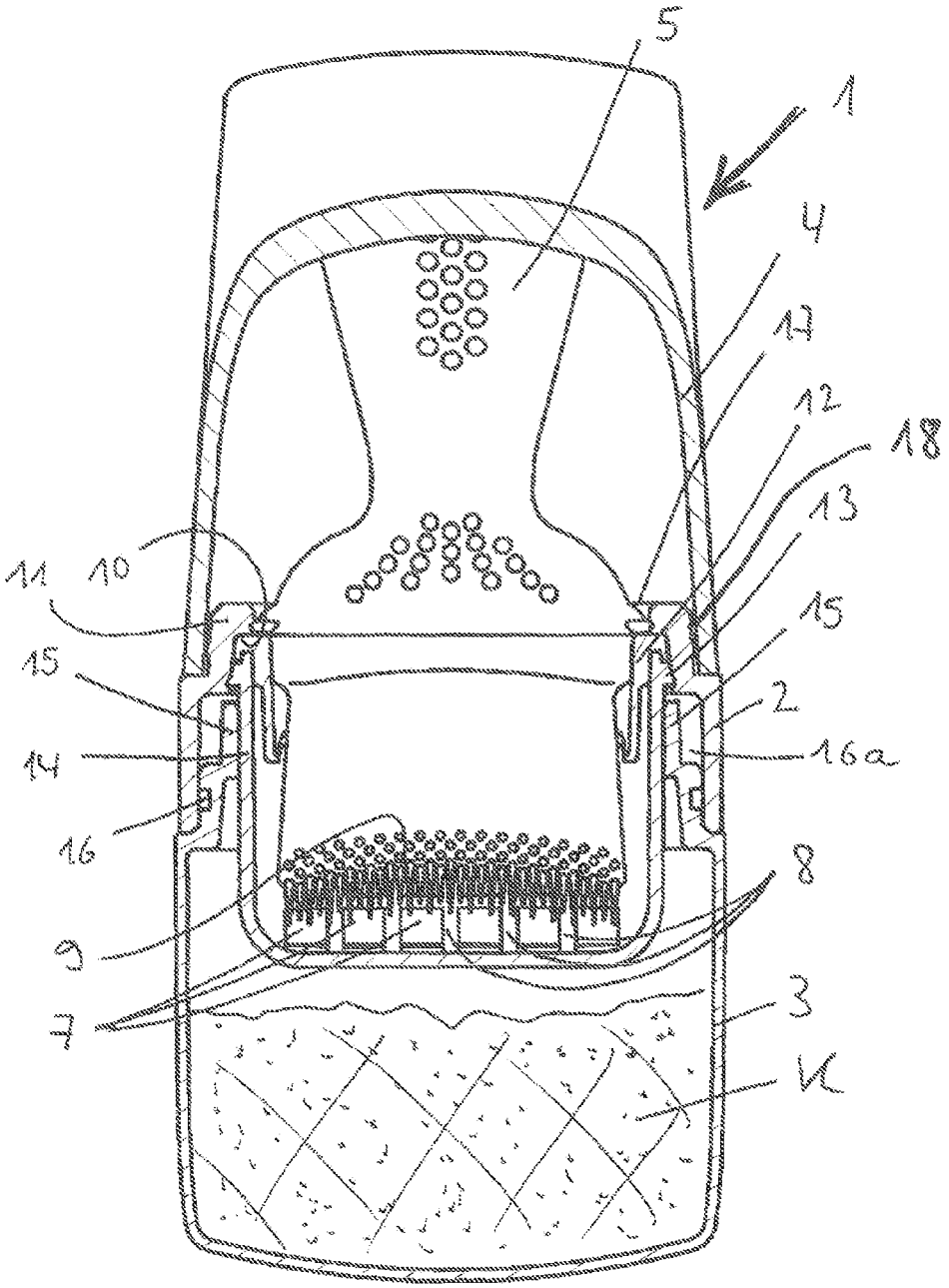
FIG. 2 shows a section through the applicator along a second cutting line.
Figure 3:
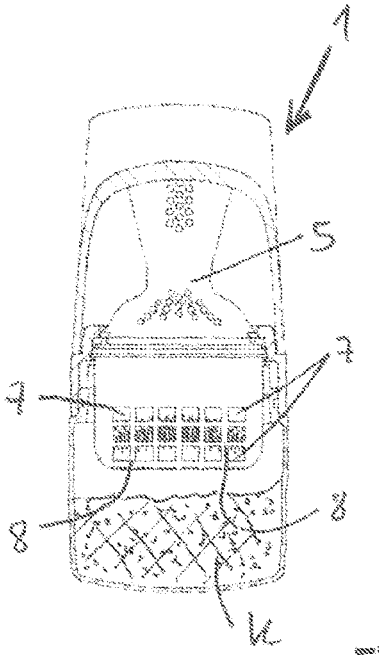
FIGS. 3 to 6 show various other sections through the exemplary embodiment from FIGS. 1 and 2.
Figure 4:
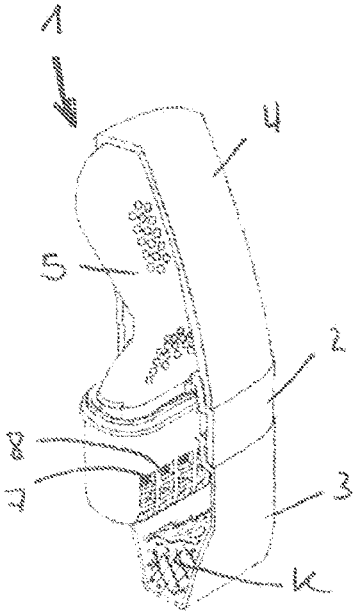
Figure 5:
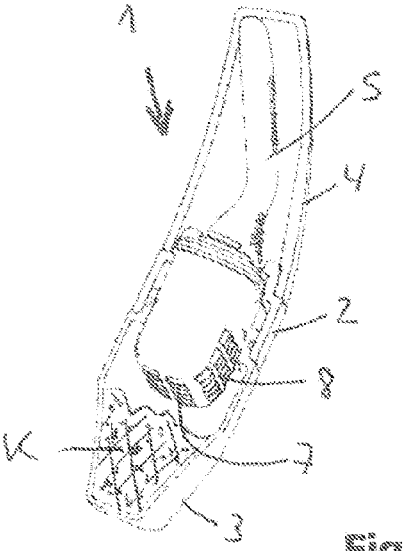
Figure 6:
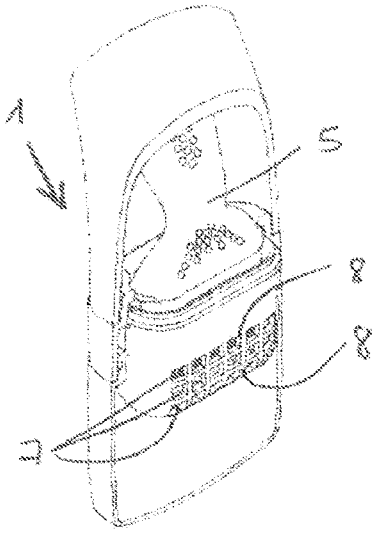

As is clearly shown in FIG. 1, the reservoir of the cosmetic unit 1 that accommodates the actual applicator section 9 is composed of a first part 2 and a second part 3. The reservoir is completed by a partition wall 6, which is embodied in the form of a basket, and a stripper 12. The cosmetic unit 1 is comprised of the above-mentioned parts along with the cosmetic applicator 5 and the cap 4 that is screwed or snapped (as in FIG. 1) onto the first part 2.

The first part of the reservoir is preferably composed of a hard elastic plastic, i.e. a plastic that essentially cannot be compressed with the bare hand and is therefore largely dimensionally stable.

By contrast, the second part of the reservoir is preferably composed of a plastic, which, with the wall thickness selected here, can be compressed to a not insignificant degree with the bare hand. Typically, a plastic is used that is suitable for blow molding. It is a kind of plastic that is frequently used for squeezable bottles (like shampoo bottles). Instead, however, a soft elastic material can also be used or a material that has an elastomer-like character.

Because of this, the plastic material used for the first part will as a rule be harder than the plastic material used for the second part. Preferably, it is also possible to use any material other than a plastic material for the first part. It is thus possible, for example, in particularly high-quality cosmetic units, to use a first part that is composed of metal and is embodied, for example, in the form of a rotationally symmetrical turned part.

When not used for a longer period of time, the stored cosmetic K collects in the lower region of the second part 3 farther away from the applicator, as shown in FIG. 1.

When the bottom section of the second part 3 of the reservoir, which in the present case tapers to a point, is squeezed by the user, this pushes at least a good portion of the cosmetic that is still stored in the reservoir—preferably most of it during the final emptying phase—into the region closer to the applicator, which is enclosed by the basket-like partition wall 6 (not shown in the drawing).

In the course of this, the cosmetic K flows through the through openings 7 in the partition walls 6 in response to the increased internal pressure produced by the squeezing of the second part 3. Since the through openings—viewed singly—each have a quite small cross section, the cosmetic also cannot immediately flow back into the region farther from the applicator when the user stops squeezing the second part 3 of the reservoir. This ensures that for quite a while, a sufficient amount of cosmetic compound to wet the applicator is available in the region closer to the applicator even though the reservoir may only have a small amount of cosmetic compound left or conversely is in fact largely filled with cosmetic compound, but due to the voluminous reservoir, most of the cosmetic compound cannot be directly reached by the actual applicator section 9.

There is no generally applicable mathematical rule governing how the internal cross-section of the individual through openings 7 must be dimensioned because this fundamentally depends on the viscosity and flow behavior of the respective cosmetic used. As a rule of thumb, however, it is possible to state that the internal cross-section of the individual through openings should be at least small enough that at least half or better still, three quarters, and ideally, more than 90% of the cosmetic compound pushed into the region closer to the applicator remains there permanently in the above-defined sense of the word. Based on this, the person skilled in the art can easily use customary tests known to specialists to determine the design that should be selected for the specific individual case.

In this connection, the user is instructed to preferably squeeze the second part 3 of the reservoir only after having removed the cosmetic applicator 5 from its seat in the first part 2 of the reservoir and thus ensuring the ventilation of the region closer to the applicator, inside the basket-like partition wall 6. Alternatively, a suitable ventilation opening can also be provided, which prevents the squeezing of the reservoir from producing an air cushion in the region closer to the applicator inside the basket-like partition wall 6, which would prevent the cosmetic from traveling through the through openings 7 of the basket-like partition wall 6.

As is clearly shown in FIG. 1, the second part 3 of the reservoir is provided with a tapered circumferential region. With this region, it is slid into the first part 2 of the reservoir. In this region, the wall thickness of the second part 3 is preferably at least 20%, but better still 40% greater than the wall thickness in the region that is supposed to be squeezed. This is also quite clearly shown in FIG. 1. Such a thicker wall thickness can also be produced easily, particularly in a blow molded part.

The whole is preferably embodied so that the junction between the first and second parts of the reservoir produces an essentially smooth transition.

Preferably, the tapered, circumferential region of the second part 3 of the reservoir and the corresponding region that accommodates it on the first part of the reservoir are matched to each other in size so that the second part 3 of the reservoir can be inserted into the first part 2 of the reservoir so that an elastic prestressing in the radial direction is produced between the two surfaces of these two parts that come to rest against each other. This elastic prestressing therefore contributes to sealing the junction between these two parts. In addition, as shown in FIG. 1, one of the two parts (in this case, the second part 3 of the reservoir) is provided with a full-perimeter groove or detent groove 16 that either accommodates an additional sealing ring (generally too expensive), a quantity of glue that secures the connection, or a corresponding detent bead, not graphically depicted in FIG. 1, of the opposing part. This secures and/or seals the connection (possibly also only in supplementary fashion). Preferably, this produces a seal in any case.

FIG. 1 also shows that the second part 3 of the reservoir does not end approximately adjacent to the region in which it contacts the first part 2 of the reservoir. Instead, the second part 3 of the reservoir extends a fair distance farther into the first part 2 of the reservoir and in it, constitutes a preferably freely projecting support section 15 that is not directly supported against the first part of the reservoir.

This support section 15 is preferably shaped and dimensioned so that it comes into sealed contact with the basket-like partition wall 6, preferably so that a radial prestressing is produced between the support section 15 and the surface of the basket-like partition wall 6 contacted by it. The basket-like partition wall 6 is thus supported on the one hand and sealed on the other so that no cosmetic compound can get into the cavity 16*a*. In any case, the region of the basket-like partition wall 6 that comes directly into contact with the support section 15 is continuous in the circumference direction, i.e. constitutes an intrinsically closed circumference region that is free of openings.

The first part 2 of the reservoir is preferably equipped with a section that forms a seat 18 onto which the cap 4 can be snapped. The first part 2 of the reservoir constitutes an insertion opening 17 through which the cosmetic applicator 5 can be slid into the reservoir from the outside.

The basket-like partition wall 6 in this case is embodied in the form of a basket that is open at one end. This basket accommodates the stripper 12, which has a surface extending in the circumference direction that helps to seal the stripper 12 against the inner circumference of the basket.

The basket or basket-like partition wall 6 is inserted from the inside of the future reservoir into the receptacle 10 with which the first part 2 of the reservoir is equipped for holding the basket-like partition wall 6 and stripper 12 in position. The first part 2 of the reservoir has a circumferential collar 11. The basket-like partition wall 6 is supported against this collar on the first part 2 of the reservoir via the stripper 12 as soon as the withdrawal of the cosmetic applicator 5 causes forces to be exerted, which tend to pull the stripper and/or the basket-like partition wall 6 outward. Such a support is extremely useful because in the present embodiment, the cosmetic applicator 5, at least as it is being withdrawn, exerts not insignificant forces on the stripper 12. On the one hand, this is due to the fact that the cosmetic applicator 5 has a surface extending in the circumference direction, which comes into snug contact with a part of a circumferentially extending inner surface of the stripper in order to seal the reservoir when the cosmetic applicator 5 is inserted all the way into it. On the other hand, the cosmetic applicator 5, at least as it is being withdrawn, also exerts not insignificant forces on the stripper 12 because it preferably also engages the latter in detent fashion. This ensures that the cosmetic applicator 5 reliably remains in its home position that seals the reservoir whenever it is not being intentionally withdrawn.

The basket or basket-like partition wall 6 is equipped with a detent mechanism with which it can be snapped into the receptacle 10. In the exemplary embodiment shown in FIG. 1, this detent mechanism is embodied in the form of a detent projection 13 that snaps into a corresponding detent groove, not shown in detail, of the first part 2 of the reservoir.

In this way, the stripper 12 is also fixed in its correct position, preferably without a separate detent engagement being provided between the stripper 12 and the first part 2 of the reservoir. To be specific, the stripper is secured in a form-locked fashion between the basket or basket-like partition wall 6 and the circumferential collar 11 of the first part 2 of the reservoir, preferably in a force fit in that the two above-mentioned parts exert a certain amount of pressure on it.

In order to ensure a truly optimal securing of the stripper 12, it has a circumferential collar on its side oriented toward the applicator handle, with which it encloses the upper edge of the basket or basket-like partition wall 6 in a form-locked fashion. This ensures that even when powerful forces are exerted on the stripper, the circumferential collar of the stripper 12 cannot be pulled out of the seat between the basket or basket-like partition wall 6 and the circumferential collar of the first part 2 of the reservoir.

The cosmetic applicator 5 is preferably (but not exclusively) a flat cosmetic applicator that is not round, but instead has an elongated set of bristles. Such an elongated set of bristles features the fact that it has a significantly greater span in a first direction than it does in a second direction extending perpendicular thereto, with the above-mentioned first direction being essentially perpendicular or inclined (preferably by an acute angle >75° or better still >85°) relative to the longitudinal axis of the applicator handle.

The invention claimed is:

1. A cosmetic unit, in particular a mascara unit, comprising:

a reservoir for containing a cosmetic compound; and a cosmetic applicator for applying the cosmetic compound, wherein the cosmetic applicator can be inserted into the reservoir so that the cosmetic applicator is loaded with the cosmetic compound contained in the reservoir;

wherein the reservoir has a first part and a second part that are directly connected to each other, and the reservoir comprises at least one wall section that is elastically embodied so that by exerting pressure on the at least one wall section, a significant portion of the stored cosmetic compound can be pushed out of a reservoir region that is farther from the applicator into a reservoir region that is closer to the applicator; and the region closer to the applicator is separated from the region farther from the applicator by a partition wall that is embodied in the form of a basket and has a plurality of through openings spaced apart from one another through which the cosmetic compound can be pushed into the region closer to the applicator; and the first part of the reservoir has a receptacle into which the basket-like partition wall can be slid only from the reservoir region that is closer to the applicator, and the receptacle has at least one projection or circumferential collar that makes it essentially impossible for the basket-like partition wall to be pulled out of the cosmetic unit after the cosmetic unit has been completely assembled.

2. The cosmetic unit according to claim 1, wherein the partition wall is embodied and situated so that when the applicator is inserted all the way into the reservoir, the partition wall provides an enclosure on five sides for at least a part of a section of the applicator directly used for application.

3. The cosmetic unit according to claim 1, wherein essentially only a bottom surface of the basket-like partition wall is provided with through openings.

4. The cosmetic unit according to claim 1, wherein essentially only a bottom surface and two large side surfaces of the basket-like partition wall are provided with through openings.

5. The cosmetic unit according to claim 1, wherein a cumulative area of bridge pieces between the through openings is smaller than an area occupied by a sum of the through openings.

6. The cosmetic unit according to claim 1, wherein the first part of the reservoir is made of an essentially rigid material, and the second part of the reservoir is made of a material that is significantly more flexible than the first part.

7. The cosmetic unit according to claim 1, wherein the first and second parts of the reservoir are connected to each other by a sealed detent connection.

8. The cosmetic unit according to claim 1, wherein the first or second part of the reservoir has at least one full-perimeter sealing strip extending in a circumference direction, which is embraced by a likewise full-perimeter sealing groove of the second or first part.

9. The cosmetic unit according to claim 1, wherein the first part of the reservoir has an insertion opening through which the cosmetic applicator can be slid into the reservoir from the outside.

10. The cosmetic unit according to claim 1, wherein a component comprising the partition wall represents another component that is separate from the reservoir and constitutes a third part of the reservoir.

11. The cosmetic unit according to claim 10, wherein the component comprising the partition wall is attached to the first part of the reservoir with detent engagement.

12. The cosmetic unit according to claim 1, wherein the cosmetic unit includes a stripper that is slid into the basket-like partition wall so that the partition wall encompasses the basket-like partition in a form-locked fashion along a circumference of the basket-like partition wall.

13. The cosmetic unit according to claim 12, wherein the receptacle of the first part is embodied so that the basket-like partition wall, together with the stripper that the basket-like partition wall encompasses in a form-locked fashion, can be slid into the receptacle of the first part from the side of the future reservoir; and only the basket-like partition wall is detent-connected to the first part, while the stripper has a collar that is secured in form-locked fashion between at least one projection or collar of the first part and the basket-like partition wall.

14. The cosmetic unit according to claim 1, wherein the partition wall is embodied in the form of a basket, and the basket-like partition wall has an intrinsically closed circumference region, that is, a circumference region that is free of through openings.

15. The cosmetic unit according to claim 14, wherein the second part of the reservoir rests against the basket-like partition wall in some regions in such a way that the second part of the reservoir supports the basket-like partition wall in the intrinsically closed circumference region of the basket-like partition wall.

16. The cosmetic unit according to claim 1, wherein the second part of the reservoir rests against some regions of the basket-like partition wall so that the second part of the reservoir is sealed relative to the basket-like partition wall and therefore delimits space of the reservoir that is available for storing the cosmetic compound.

17. The cosmetic unit according to claim 1, wherein the cosmetic compound in the reservoir is a liquid, a paste, or a gel, with a viscosity in a range from 1.5 mPa·s to 500,000 mPa·s, measured with a rotation viscometer (plate/plate).

18. The cosmetic unit according to claim 1, for applying a cosmetic compound in the form of a liquid, a paste, or a gel, in which the cosmetic applicator is a brush with injection molded bristles.

* * * * *